US006516948B1

(12) United States Patent
Caballero

(10) Patent No.: US 6,516,948 B1
(45) Date of Patent: Feb. 11, 2003

(54) ITEM CARRYING SYSTEM

(76) Inventor: Jose A. Caballero, 3131 Herman Ave., San Diego, CA (US) 92104

( * ) Notice: Subject to any disclaimer, the term of this patent is extended or adjusted under 35 U.S.C. 154(b) by 0 days.

(21) Appl. No.: 09/797,626

(22) Filed: Mar. 5, 2001

(51) Int. Cl.[7] ..... B65D 85/28
(52) U.S. Cl. ..... 206/373; 206/564
(58) Field of Search ..... 206/373, 372, 206/349, 561, 557, 564; 220/533

(56) References Cited

U.S. PATENT DOCUMENTS

| | | | | | |
|---|---|---|---|---|---|
| 2,247,341 | A | | 6/1941 | Anderson | |
| 3,628,843 | A | | 12/1971 | Wynne | |
| 4,884,689 | A | * | 12/1989 | Su-Chin | 206/372 |
| 4,927,016 | A | | 5/1990 | Fuller | |
| D311,623 | S | * | 10/1990 | Thompson | D3/308 |
| 4,971,356 | A | | 11/1990 | Cook | |
| D329,135 | S | * | 9/1992 | Embree | D3/308 |
| D346,682 | S | * | 5/1994 | Trovato | D3/308 |
| 5,439,108 | A | | 8/1995 | Lackie | |
| 5,454,478 | A | * | 10/1995 | Everson | 220/23.83 |
| D369,242 | S | * | 4/1996 | Tiramani | D3/308 |
| 5,553,710 | A | * | 9/1996 | Takama | 206/561 |
| 5,570,784 | A | * | 11/1996 | Sidabras et al. | 206/378 |
| D389,309 | S | | 1/1998 | Shaw | |
| 5,826,718 | A | * | 10/1998 | Ahern et al. | 206/372 |
| 5,887,715 | A | * | 3/1999 | Vasudeva | 206/373 |
| 5,893,457 | A | * | 4/1999 | Wei | 206/373 |
| 6,070,732 | A | * | 6/2000 | Chen | 206/373 |
| 6,279,744 | B1 | * | 8/2001 | Yu | 206/372 |

* cited by examiner

*Primary Examiner*—Shian Luong

(57) ABSTRACT

A item carrying system for providing space-efficient tool storage and transportation. The item carrying system includes a housing with a pair of storage spaces, each of the storage spaces has an open top designed for permitting insertion of an item into the respective storage space, and a plurality of containers which are removably insertable within one of the storage spaces, each of the containers is designed for holding at least one of the items.

3 Claims, 4 Drawing Sheets

ITEM CARRYING SYSTEM

BACKGROUND OF THE INVENTION

1. Field of the Invention

The present invention relates to tool boxes and more particularly pertains to a new item carrying system for providing space-efficient tool storage and transportation.

2. Description of the Prior Art

The use of tool boxes is known in the prior art. More specifically tool boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,628,843; 5,439,108; 4,971,356; 4,927,016; 2,247,341; and U.S. Pat. No. Des. 389,309.

While these devices fulfill their respective, particular objectives and requirements, the aforementioned patents do not disclose a new item carrying system. The inventive device includes a housing with a pair of storage spaces, each of the storage spaces has an open top designed for permitting insertion of an item into the respective storage space, and a plurality of containers which are removably insertable within one of the storage spaces, each of the containers is designed for holding at least one of the items.

In these respects, the item carrying system according to the present invention substantially departs from the conventional concepts and designs of the prior art, and in so doing provides an apparatus primarily developed for the purpose of providing space-efficient tool storage and transportation.

SUMMARY OF THE INVENTION

In view of the foregoing disadvantages inherent in the known types of tool boxes now present in the prior art, the present invention provides a new item carrying system construction wherein the same can be utilized for providing space-efficient tool storage and transportation.

The general purpose of the present invention, which will be described subsequently in greater detail, is to provide a new item carrying system apparatus and method which has many of the advantages of the tool boxes mentioned heretofore and many novel features that result in a new item carrying system which is not anticipated, rendered obvious, suggested, or even implied by any of the prior art tool boxes, either alone or in any combination thereof.

To attain this, the present invention generally comprises a housing with a pair of storage spaces, each of the storage spaces has an open top designed for permitting insertion of an item into the respective storage space, and a plurality of containers which are removably insertable within one of the storage spaces, each of the containers is designed for holding at least one of the items.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new item carrying system apparatus and method which has many of the advantages of the tool boxes mentioned heretofore and many novel features that result in a new item carrying system which is not anticipated, rendered obvious, suggested, or even implied by any of the prior art tool boxes, either alone or in any combination thereof.

It is another object of the present invention to provide a new item carrying system which may be easily and efficiently manufactured and marketed.

It is a further object of the present invention to provide a new item carrying system which is of a durable and reliable construction.

An even further object of the present invention is to provide a new item carrying system which is susceptible of a low cost of manufacture with regard to both materials and labor, and which accordingly is then susceptible of low prices of sale to the consuming public, thereby making such item carrying system economically available to the buying public.

Still yet another object of the present invention is to provide a new item carrying system which provides in the apparatuses and methods of the prior art some of the advantages thereof, while simultaneously overcoming some of the disadvantages normally associated therewith.

Still another object of the present invention is to provide a new item carrying system for providing space-efficient tool storage and transportation.

Yet another object of the present invention is to provide a new item carrying system which includes a housing with a pair of storage spaces, each of the storage spaces has an open top designed for permitting insertion of an item into the respective storage space, and a plurality of containers which are removably insertable within one of the storage spaces, each of the containers is designed for holding at least one of the items.

Still yet another object of the present invention is to provide a new item carrying system that can be readily reconfigured as the needs of the user change.

Even still another object of the present invention is to provide a new item carrying system that provides a quick method of changing the tools carried for differing tasks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
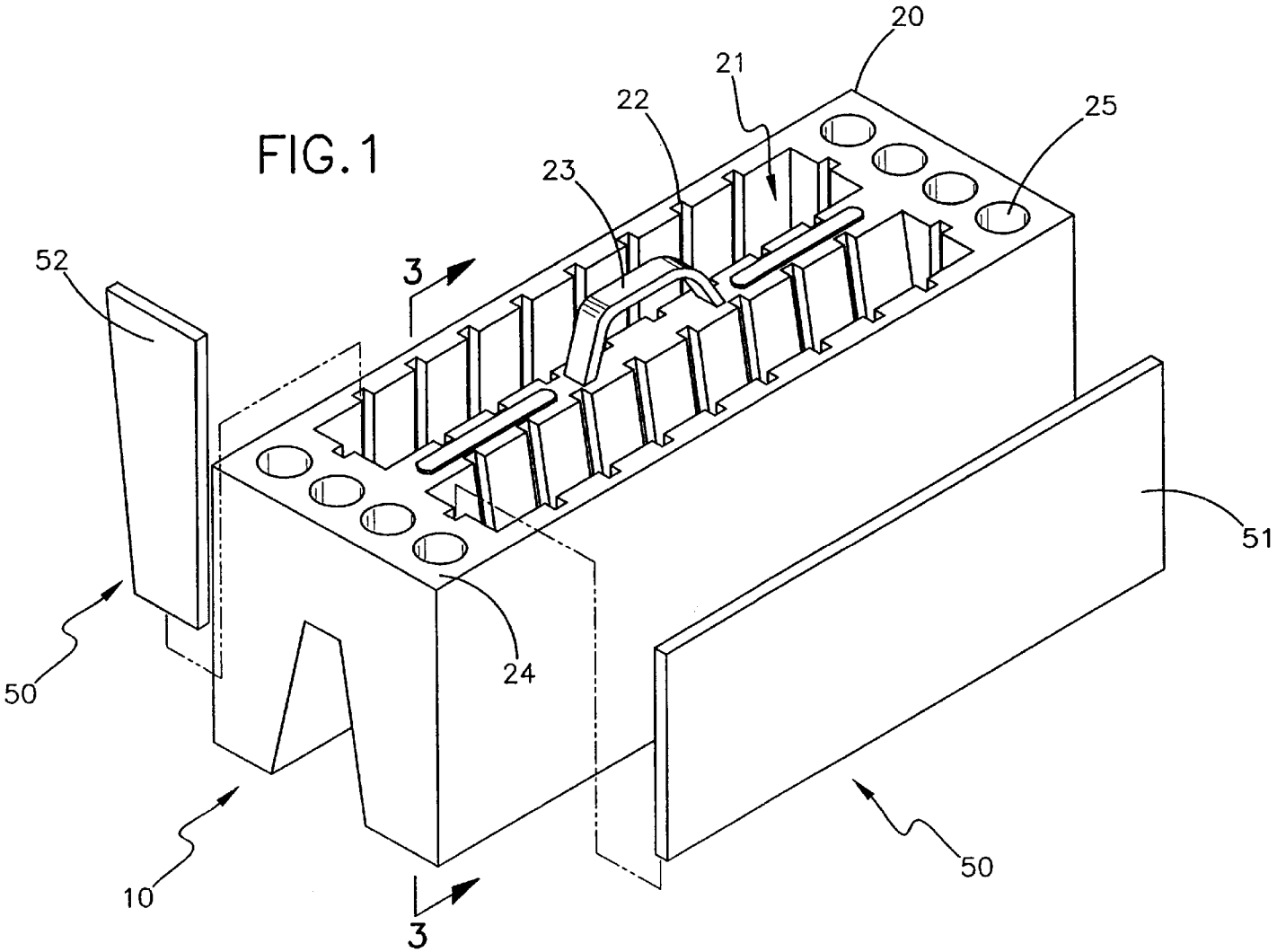
FIG. 1 is a schematic perspective view of a new item carrying system according to the present invention.
Figure 2:
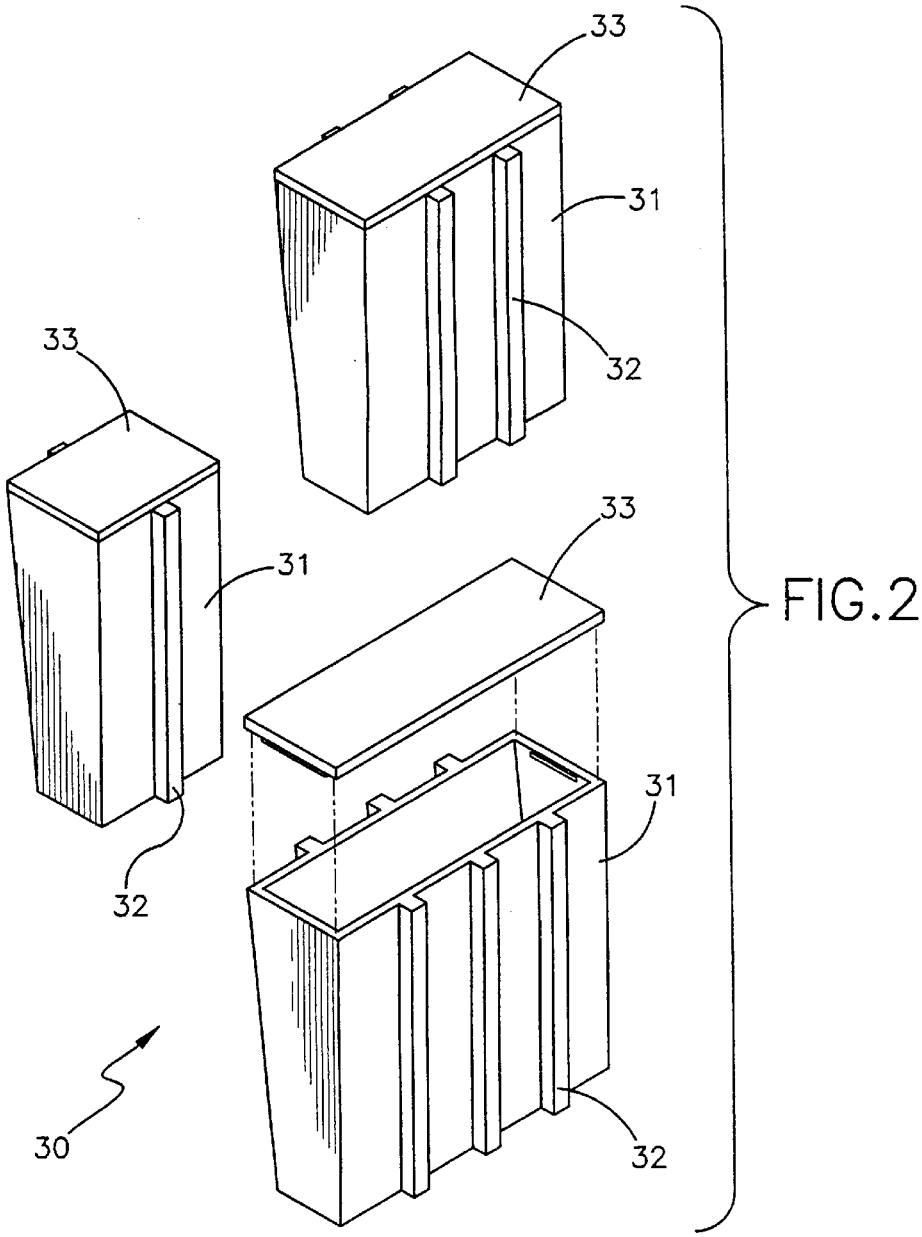
FIG. 2 is a schematic perspective detail view of the containers of the present invention.
Figure 3:
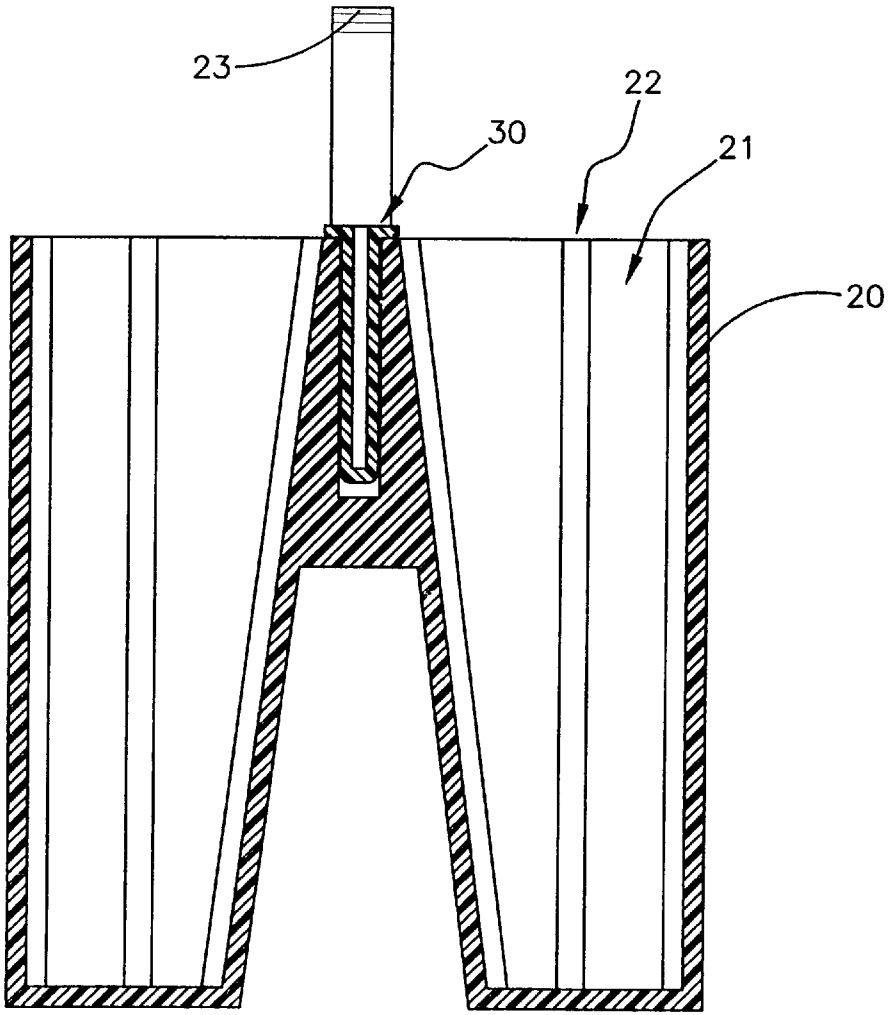
FIG. 3 is a schematic cross-sectional view of the present invention taken line 3—3 of FIG. 1.
Figure 4:
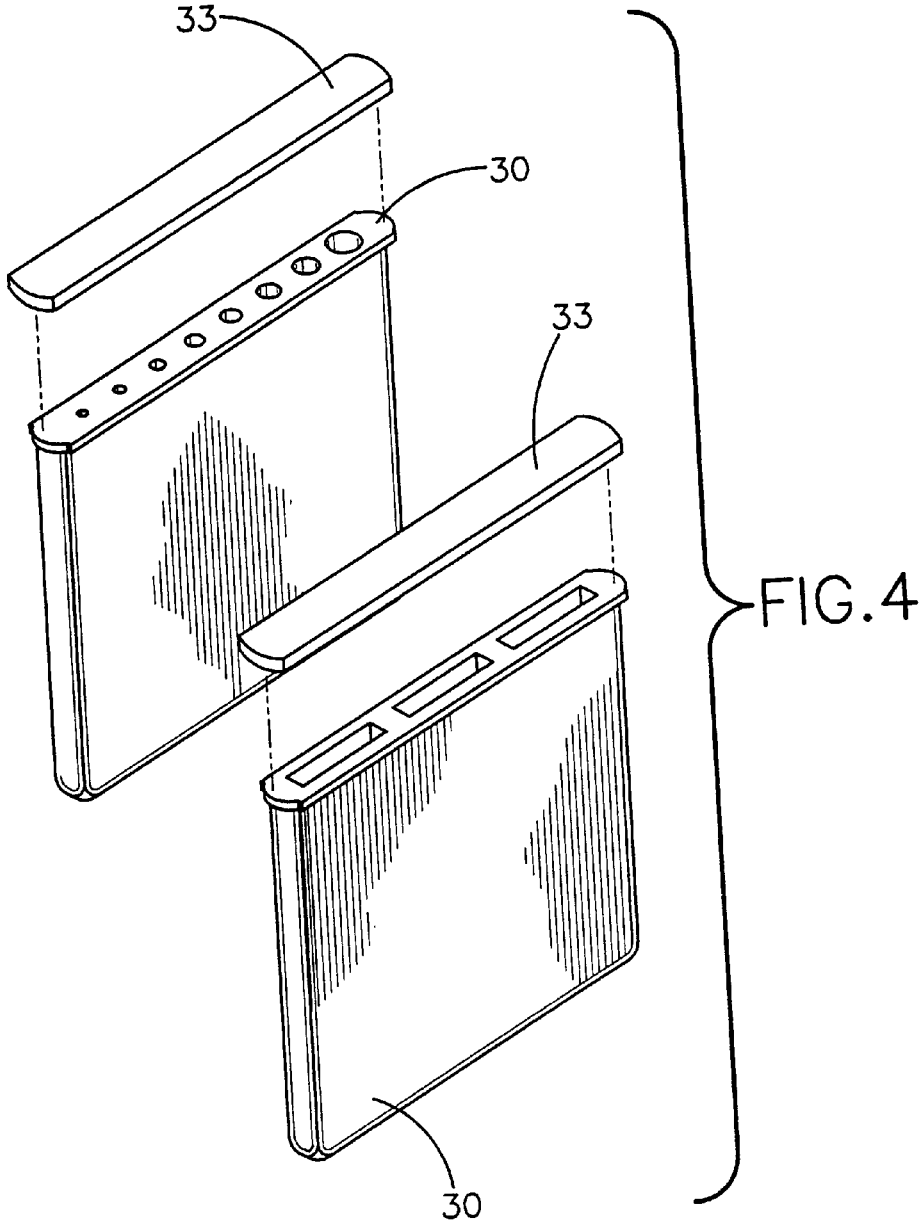
FIG. 4 is a schematic perspective view of the containers present invention.

With reference now to the drawings, and in particular to FIGS. 1 through 4 thereof, a new item carrying system embodying the principles and concepts of the present invention and generally designated by the reference numeral 10 will be described.

As best illustrated in FIGS. 1 through 4, the item carrying system 10 generally comprises an housing 20, a plurality of containers 30, and a plurality of dividers 50.

The housing 20 includes a pair of storage spaces 21. Each of the storage spaces 21 includes an open top such that the open top is designed for permitting insertion of an item into the respective storage space 21.

Each one of the plurality of containers 30 is removably insertable within one of the storage spaces 21. Each of the containers 30 includes a perimeter wall 31 such that the perimeter wall 31 defines an interior space and includes an open top. Each of the containers 30 is designed for at least one of the items.

In an embodiment each of the storage spaces 21 is defined by a perimeter. A plurality of channels 22 is arranged around the perimeter of each of the storage spaces 21.

Each one of a plurality of the dividers 50 is used for insertion into an opposing pair of the channels 22 such that the dividers 50 are for dividing each of the storage spaces 21 into smaller compartments.

The plurality of dividers 50 comprises at least one first divider 51 such that the first divider 51 is for dividing a length of the storage spaces 21 into smaller compartments. The plurality of dividers 50 comprises at least one second divider 52 such that the second divider 52 is for dividing a width of the storage spaces 21 into smaller compartments.

Each of the containers 30 has a plurality of tabs 32 positioned along opposing sides of the perimeter wall 31 of each of the containers 30 such that each of the tabs 32 of the containers 30 is for removably inserting into one of the channels 22. Thus the tabs 32 secure the containers 30 into one of the storage spaces 21.

Each of the containers 30 has a lid 33, which is removably coupled to a top end of the respective container 30 such that the lid 33 is for closing the open top of the interior space of the respective container 30.

The housing 20 has a handle 23 for facilitating transporting of the housing 20. The housing 20 has a pair of end portions 24. Each of the end portions 24 includes a plurality of bores 25 such that each of the bores 25 is designed for storing items.

In use, the user selects the desired dividers and containers to configure the item carrying system. The desired items are then inserted into the respective bores, interior spaces and containers. Lids are attached to the containers and spaced as desired to hold items.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A item carrying system for carrying tools, the tool carrying system comprising:

a housing having a pair of storage spaces, each of the storage spaces having an open top such that the open top is adapted for permitting insertion of an item into the respective storage space;

a plurality of containers being removably insertable within one of the storage spaces, each of the containers having a perimeter wall such that the perimeter wall defines an interior space having an open top, each of the containers being adapted for at least one of the items;

each of the storage spaces being defined by a perimeter, a plurality of channels being arranged around the perimeter of each of the storage spaces; and a plurality of dividers, each of the dividers being for insertion into an opposing pair of the channels such that the dividers are for dividing each of the storage spaces into smaller compartments;

wherein the plurality of dividers comprises at least one first divider such that the first divider is for dividing a length of the storage spaces into smaller compartments;

wherein the plurality of dividers comprises at least one second divider such that the second divider is for dividing a width of the storage spaces into smaller compartments;

wherein each of the containers has a plurality of tabs positioned along opposing sides of the perimeter wall of each of the containers such that each of the tabs of the containers is for removably inserting into one of the channels whereby the tabs secure the containers into one of the storage spaces;

wherein each of the containers has a lid removably coupled to a top end of the respective container such that the lid is for closing the open top of the interior space of the respective container; and wherein the housing has a handle for facilitating transporting of the housing.

2. The system as set forth in claim 1, wherein the housing has a pair of end portions, each of the end portions having a plurality of bores such that each of the bores are adapted for storing items.

3. A item carrying system for carrying tools, the tool carrying system comprising:

a housing having a pair of storage spaces, each of the storage spaces having an open top such that the open top is adapted for permitting insertion of an item into the respective storage space;

a plurality of containers being removably insertable within one of the storage spaces, each of the containers having a perimeter wall such that the perimeter wall defines an interior space having an open top, each of the containers being adapted for at least one of the items;

wherein each of the storage spaces being defined by a perimeter, a plurality of channels being arranged around the perimeter of each of the storage spaces;

a plurality of dividers, each of the dividers being for insertion into an opposing pair of the channels such that the dividers are for dividing each of the storage spaces into smaller compartments;

the plurality of dividers comprises at least one first divider such that the first divider is for dividing a length of the storage spaces into smaller compartments;

the plurality of dividers comprises at least one second divider such that the second divider is for dividing a width of the storage spaces into smaller compartments;

each of the containers has a plurality of tabs positioned along opposing sides of the perimeter wall of each of the containers such that each of the tabs of the containers is for removably inserting into one of the channels whereby the tabs secure the containers into one of the storage spaces;

each of the containers has a lid removably coupled to a top end of the respective container such that the lid is for closing the open top of the interior space of the respective container;

the housing has a handle for facilitating transporting of the housing; and the housing has a pair of end portions, each of the end portions having a plurality of bores such that each of the bores are adapted for storing items.

* * * * *